US005146272A

United States Patent [19]

Watanabe

[11] Patent Number: 5,146,272

[45] Date of Patent: Sep. 8, 1992

[54] IMAGE FORMING APPARATUS HAVING ADJUSTABLE SPEED DOCUMENT SCANNING MEANS WHICH CONVERTS PRINTED IMAGE INFORMATION INTO AN ELECTRONIC IMAGE

[75] Inventor: Junji Watanabe, Yokohama, Japan

[73] Assignee: Kabushiki Kaisha Toshiba, Kawasaki, Japan

[21] Appl. No.: 674,090

[22] Filed: Mar. 25, 1991

[30] Foreign Application Priority Data

Mar. 30, 1990 [JP] Japan ..... 2-84620

[51] Int. Cl.[5] ..... G03G 21/00

[52] U.S. Cl. ..... 355/208; 355/204; 355/214; 355/235

[58] Field of Search ..... 355/208, 214, 233, 235, 355/210, 204, 246, 243

[56] References Cited

U.S. PATENT DOCUMENTS 4,411,514 10/1983 Komori et al. ..... 355/208
4,707,114 11/1987 Aoki ..... 355/214 X
4,922,296 5/1990 Kasuya et al. ..... 355/208
4,947,209 8/1990 Maeno et al. ..... 355/208 X
5,030,994 7/1991 Roman et al. ..... 355/235

*Primary Examiner*—A. T. Grimley
*Assistant Examiner*—P. Stanzione
*Attorney, Agent, or Firm*—Foley & Lardner

[57] ABSTRACT

A copying machine which can operate in a mode newly selected by an operator, without the necessity of changing the copying conditions set at the start of the copying process, and which can also operate in the mode initially selected by the operator as soon as the operator selects the initial mode again. The copying machine can be set in a high-speed copying mode after it has produced the first hard copy, if the image being copied is formed of characters only, thereby to produce other copies at high speed. The other copies are produced without a break, thus reducing the amount of toner and paper, and also the copying time, to a minimum. This helps decrease the copying costs.

7 Claims, 14 Drawing Sheets

IMAGE FORMING APPARATUS HAVING ADJUSTABLE SPEED DOCUMENT SCANNING MEANS WHICH CONVERTS PRINTED IMAGE INFORMATION INTO AN ELECTRONIC IMAGE

BACKGROUND OF THE INVENTION

1. Field of the Invention

The present invention relates to an image forming apparatus, and more particularly to an image forming apparatus of the electrostatic type which converts image information printed on a document into an electronic image and then renders the information visible, thereby copying the image information.

2. Description of the Related Art

Various image forming apparatuses are known which perform an electrophotographic copying process, for example, a copying machine or a printer apparatus. The copying machine or printer apparatus includes: an image reading section for illuminating an image formed on a document; an image forming section for receiving the light reflected from the document, forming an electrostatic latent image from the light, and reproducing the image from the electrostatic latent image; and a material delivering section for supplying material, such as a plain paper sheet or an OHP sheet, to the image forming section, and for delivering the sheet after the image has been reproduced on the sheet.

The image reading section has a document table for supporting a document, an illuminating device for illuminating the document, and an optical unit for applying the light, reflected from the document, to the image forming section.

The image forming section has a cylindrical photoconductor, a charging device, a developing device, a transferring unit, a fixing unit, and a clearing device. The photoconductor rotates to form an electrostatic latent image which corresponds to the light reflected from the document. The charging device is used to apply an electric charge to the photoconductor. The developing device forms a visible image from the electrostatic latent image formed by the photoconductor. The transferring device is designed to transfer the visible image from the photoconductor onto the sheet. The fixing unit is designed to fix the visible image on the sheet. The cleaning device is used to change the charge distribution of the photoconductor to an initial change.

The material delivering section has paper cassettes, a paper feeder, and an outputting unit. The paper cassettes are used to contain paper sheets onto which images are to be transferred. The paper feeder is designed to feed the sheets from the cassettes to the image forming section. The outputting unit is designed to deliver the sheets, with images fixed on them, from the image forming section.

In the copying machine described above, the charging device applies a predetermined charge to the photoconductor. The light reflected from the document is applied to the photoconductor, by means of an optical unit which has a plurality of mirrors and a plurality of lens elements, thereby forming an electrostatic latent image on the periphery of the photoconductor. The electrostatic latent image corresponds to the image formed on the document. The developing device applies a developing agent, such as toner, onto the periphery of the photoconductor, thus converting the latent image to a visible image. (More specifically, the visible image known as "toner image" is transferred to the paper sheet). The toner image is transferred from the photoconductor to a paper sheet by the transferring device and then fixed on the paper sheet by the fixing unit. Then, the toner forming this image is heated and, in some case, compressed, thus fixing the toner image. The paper sheet, with the toner image thus fixed on it, is delivered from the image forming section.

The image forming apparatus of the type described above can operate in various copying modes, such as a photography mode and a color change mode. Whatever mode the operator has selected, the apparatus operates, producing a hard copy. For example, when the apparatus operates in the photography mode, it produces a hard copy having a mild contrast; when it operates in the color change mode, it produces a hard copy in a selected color, not a back-and-white hard copy.

The conventional image forming apparatus is, however, disadvantageous in the following respect. Once it has started a copying process, it cannot operate in a new mode or under new conditions, up until it finishes the copying process. In other words, to operate the apparatus in a new mode or under new conditions, the operator must wait until the apparatus completes the copying process being performed. Hence, toner and paper are inevitably wasted, increasing the copying time and cost.

SUMMARY OF THE INVENTION

An object of the present invention is to provide a copying machine which can copy image information, spending less time and cost than the conventional ones.

Another object of the invention is to provide a copying machine which can operate in a mode newly selected by an operator, without necessity of changing the copying conditions set at the start of the copying process.

Still another object of the present invention is to provide a copying machine which can operate in a newly selected mode, even after staring a copying process under desired conditions.

According to this invention, there is provided an image forming apparatus, comprising: means for moving an image bearing member in a predetermined direction; means for scanning an original image to form an latent image corresponding to the original image on said image bearing member moved by said moving means; means for developing the latent image by supplying a developing agent onto said image bearing member; means for detecting an image density of the original image; means for setting, in accordance with the image density detected by said detecting means, a first image forming mode in which said moving means and said scanning means are driven at a first speed or a second image forming mode in which said moving means and said scanning means are driven at a second speed different from the first speed; and means for controlling said moving means and said scanning means so as to drive at the speed corresponding to the mode set by said setting means, wherein said controlling means controls such that said developing means supplies a substantially constant quantity of the developing agent per unit time onto said image bearing member irrespective of the set mode.

The image forming apparatus according to this invention can operate in a mode newly selected by an operator, without any necessity for changing the copying conditions set at the start of the copying process, and can operate in the mode initially selected by the operator as soon as the operator selects the initial mode again.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
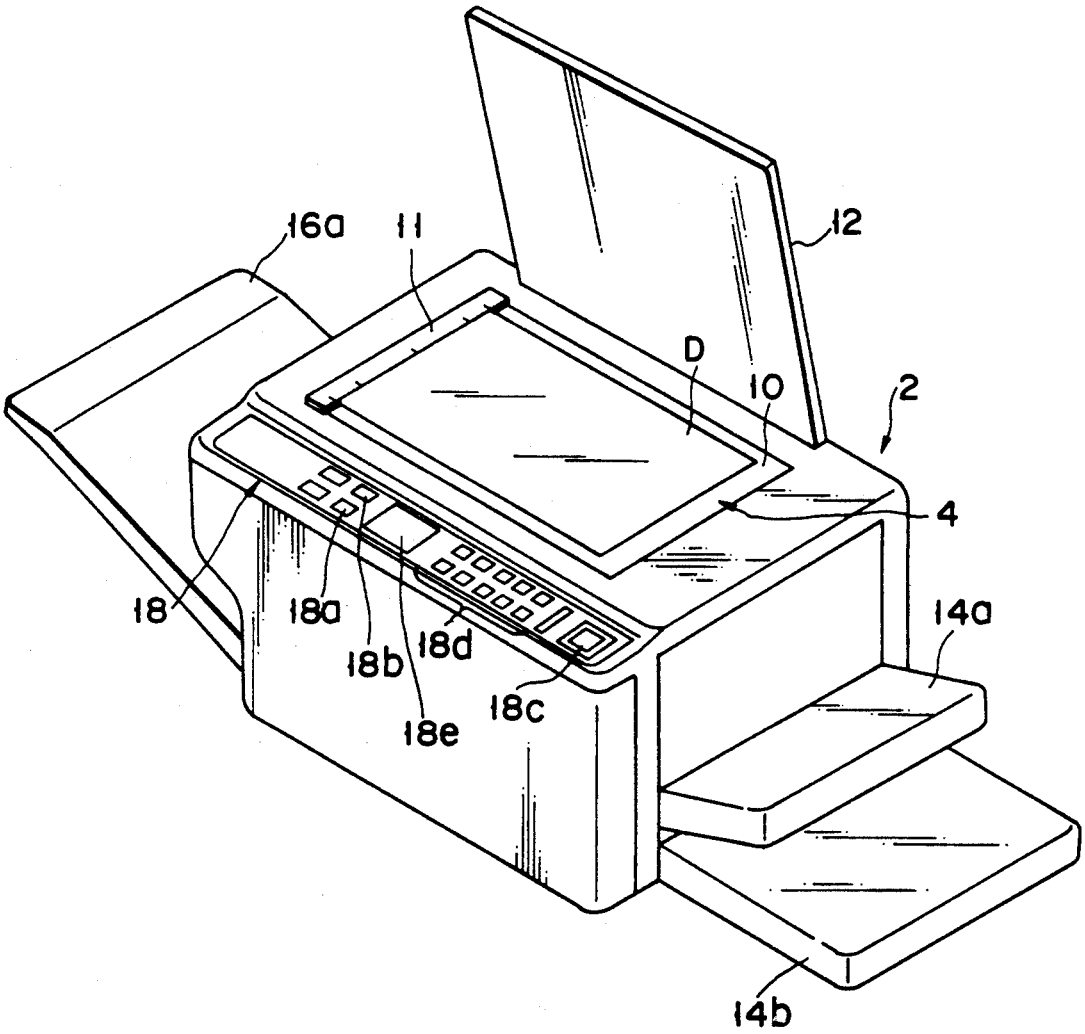
FIG. 1 is a perspective view illustrating a copying machine according to a first embodiment of the present invention.

Embodiments of the present invention will now be described, with reference to the accompanying drawings.

FIGS. 1 to 4 shows a copying machine 2 which is the first embodiment of the invention. As is evident from FIG. 2, the copying machine 2 includes an image reading section 4, an image forming section 6, and a material delivering section 8. All these sections, except for the image reading section 4, are located within the housing of the machine 2.

The image reading section 4, which is the top portion of the copying machine 2, has a document table 10, a document size plate 11, a document cover 12, and a control panel 18. The table 10 is provided for supporting a document D. The plate 11 is located at one end of the table 10, for registering the document D. The cover 12 can be opened and closed, for holding the document D on the table 10 when it is closed.

The panel 18 has various keys which an operator will push to set the desired copying conditions and to input control signals and the like. Among these keys are a color select key 18*a*, a color copying cancel key 18*b*, a print key 18*c*, and a numeral key pad 18*d*. The color select key 18*a* is pushed to input a signal so that the machine 2 produces a color copy, instead of a black-and-white copy. The color-copying cancel key 18*b* is depressed to input a signal for selecting black toner, instead of any color toner used at present. The print key 18*c* is depressed to input a signal for starting the copying process. The numeral key pad 18*d* has ten keys which are selectively pushed to input numerals "0" to "9," thereby to set a number of copies desired or input other items of data.

The control panel 18 also has a display device 18*e*. The display device 18*e* is designed to display the data items input by operating the keys 18*a*, 18*b*, 18*c* and 18*d* (e.g., the data items representing the number N of copies desired, the magnification M selected, the paper size S selected, the copy color desired), and also the conditions in which the machine 2 is operating (e.g., the copy color selected, the position where paper jam is occurring within the machine 2, and the like).

The image reading section 4 is designed to apply light to the document D placed on the document table 10, thus illuminating the document D, and to apply the light reflected from the document D to the image forming section 6.

The image forming section 6 has a photoconductor 42. The light from the image reading section 4 is applied onto the photoconductor 42, thereby forming an electrostatic latent image on the periphery of the photoconductor 42. The latent image is changed into a toner image which corresponds to the information formed on the document D.

The material delivering section 8 is designed to feed a piece of plain paper sheet P to the image forming section 6, supplies the sheet P with the image formed on it by the section 6, and deliver it from the copying machine 2.

Figure 3:
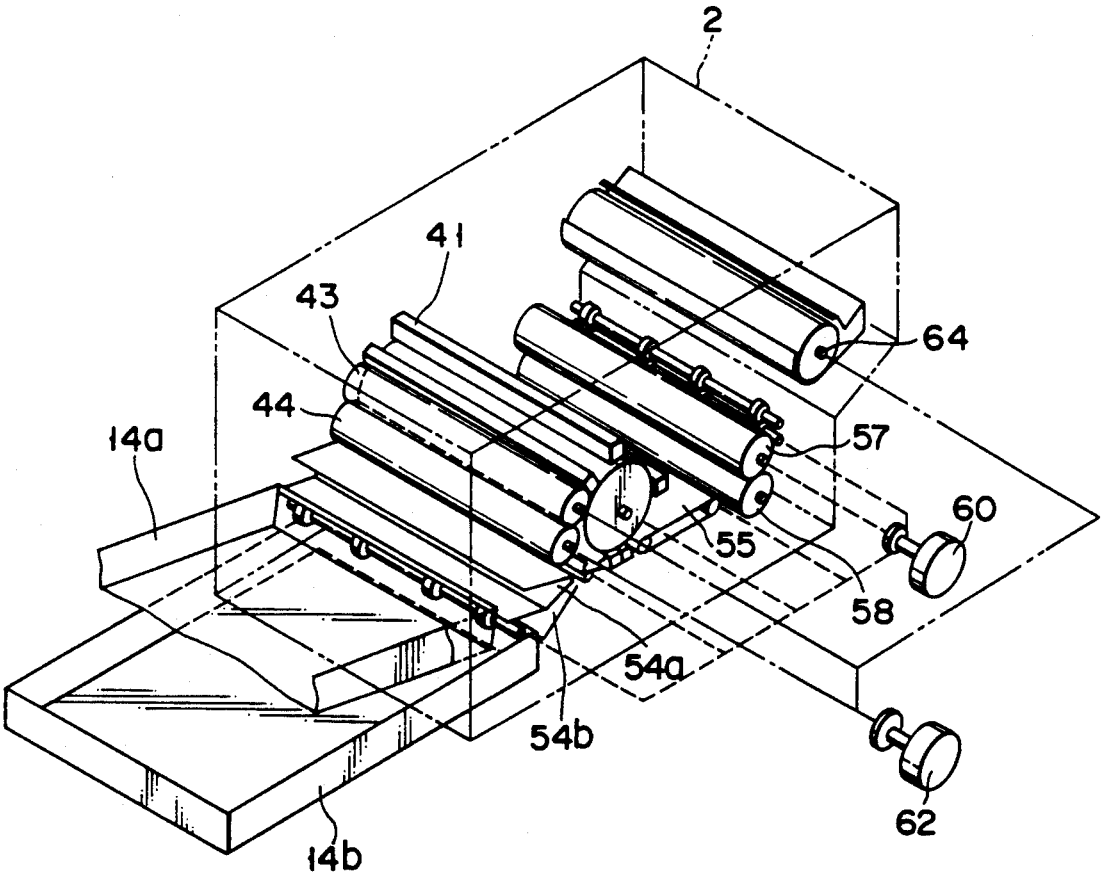
FIG. 3 is a perspective view which schematically shows the driving mechanisms incorporated in the copying machine of FIG. 1.
Figure 4:
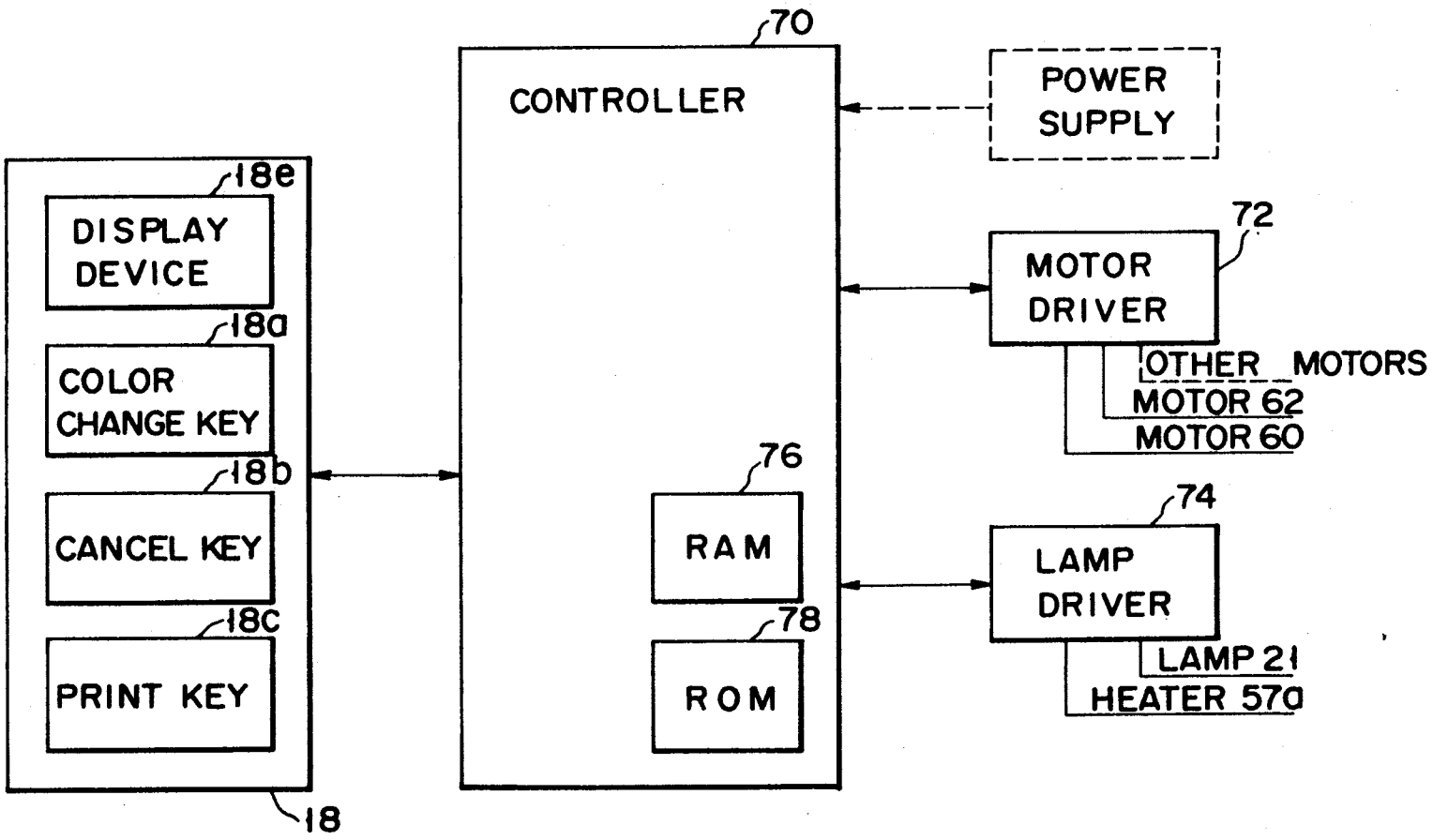
FIG. 4 is a block diagram schematically showing the controller incorporated in the copying machine illustrated in FIG. 1.

The copying machine 2 further includes two motors 60 and 62, and a cooling fan 64, as is shown in FIG. 3. Also the machine 2 has a pulse motor (not shown), a lens motor (not shown), and a controller 70 (which is schematically illustrated in FIG. 4).

Figure 2:
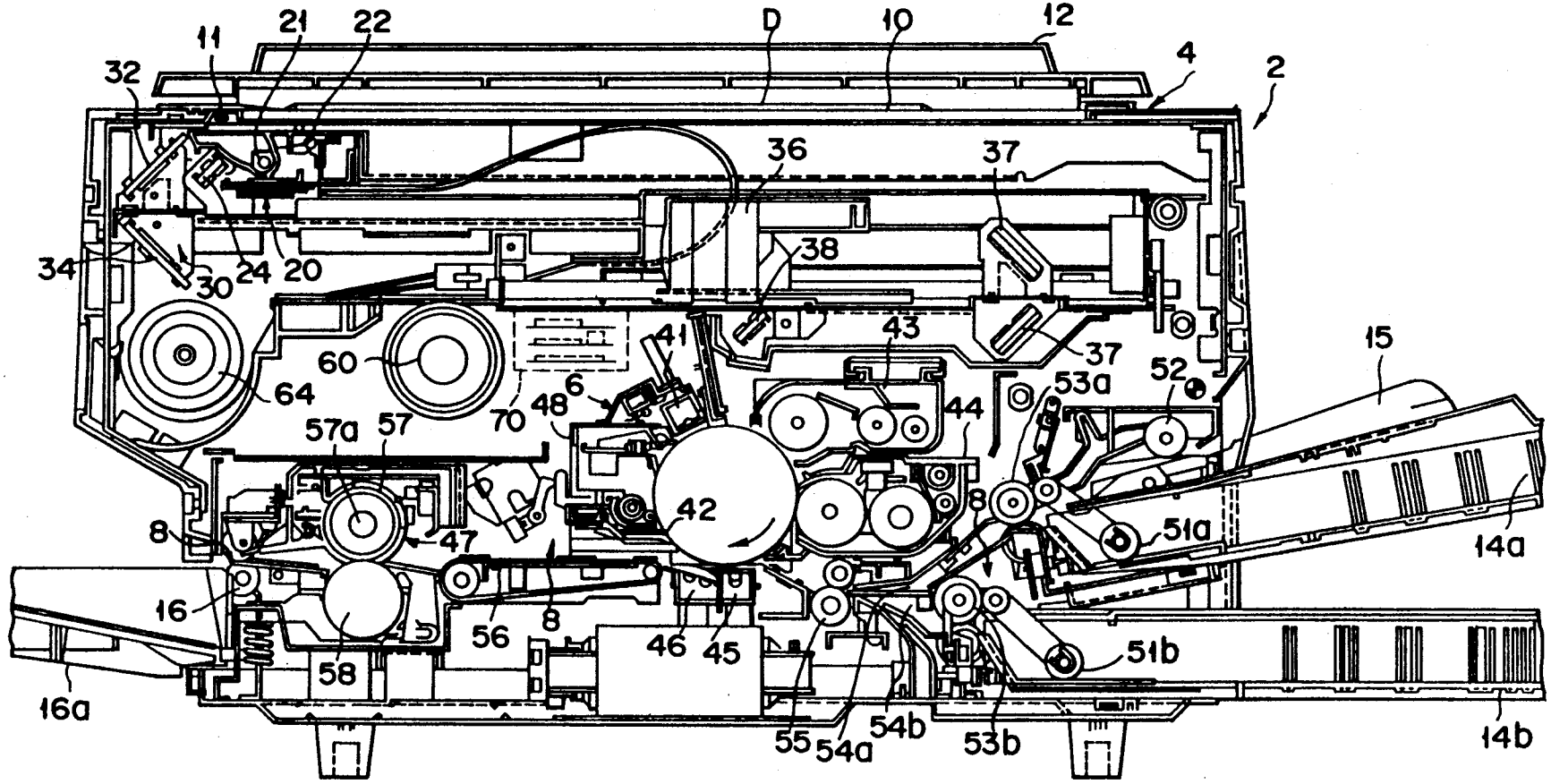
FIG. 2 is a sectional view showing the copying machine illustrated in FIG. 1.

The motor 60 drive the photoconductor 42. The motor 62 drive developing devices 43 and 44. The pulse motor is used to move carriages 20 and 30 which are shown in FIG. 2 and will be later described, and the lens motor is employed to move a lens 36 and a folding mirror 37, both shown in FIG. 2. The cooling fan 64 is used to cool the other components of the copying machine 2, in particular the document table 10.

The image reading section 4 is designed to read image information (herein after denoted an image) recorded on the document D, and supply the image to the photoconductor 42. As is illustrated in FIG. 2, the image reading section 4 has a first carriage 20 and a second carriage 30. The first carriage 20 includes a lamp 21, a reflector 22, and a primary mirror 24. The second carriage 30 includes a secondary mirror 32 and a tertiary mirror 34. The lamp 21 applies light to the document D. The reflector 22 focuses the light emitted from the lamp 21 onto the document D. The primary mirror 24 reflects the light from the document D to the secondary mirror 32. The secondary mirror 32 reflects the light from the primary mirror 24 at 90°. The tertiary mirror 34 reflects the light from the secondary mirror 32 at 90°.

The image forming section 4 further includes a lens 36, a folding mirror 37, and an exposing mirror 38. The lens 36 converges the light reflected by the tertiary mirror 34. The folding mirror 37 reflects the light passing through the lens 36 and supplies it to the exposing mirror 38. The position of the folding mirror 37 determines the distance between a rear focal plane of the lens 36 and the periphery of the photoconductor 42. The exposing mirror 38 reflects the light supplied from the folding mirror 37 and applies it to the periphery of the photoconductor 42.

Both the first carriage 20 and the second carriage 30 extend in a first direction, which will be hereinafter referred to as "main-scanning direction." The lamp 21, the reflector 22 and the primary mirror 24, all integrally formed with the first carriage 20, are elongated and extend in the main-scanning direction. Similarly, the secondary mirror 32 and the tertiary mirror 34, both integrally formed with the second carriage 30, are elongated and extend in the main-scanning direction. In other words, the first carriage 20 and the second carriage 30 are so arranged that the mirrors 24, 32 and 34 have axes parallel to the main scanning direction. The first carriage 20 and the second carriage 30 are mounted on sliding rails (not shown) and moved by a pulse motor (not shown), back and forth in parallel with the document table 10, i.e., in a sub-scanning direction which intersects with the main-scanning direction. The moving speeds of the pulse motor can be varied continuously, and both carriages 20 and 30 at the speed that corresponds to any magnification desired.

The lens 36 is coaxial, with the light applied from the tertiary mirror 34 to the exposing mirror 38. It is located in the plane parallel to the main-scanning direction. The lens 36 can be moved back and forth in its axial direction by means of a lens motor (not shown). It converges the light applied to the exposing mirror 38. When it is moved by the lens motor, it changes the magnification of the image of the document D.

The folding mirror 37, which reflects the light passing through the lens 36, and applies it to the exposing mirror 38, can be moved back and forth in the sub-scanning direction by means of a drive mechanism (not shown), thereby to compensate for the shifts of the focal point of the lens 36 and to apply the light (the optical image) onto the photoconductor 42.

The image forming section 6 is arranged below the image reading section 4. As has been described, the image forming section 6 has a photoconductor 42. As is shown in FIG. 2, the section 2 further includes a charging device 41, two developing devices 43 and 44, a transferring device 45, an AC voltage-applying unit 46, a fixing unit 47, and a cleaning unit 48. The charging device 41 applies an electric charge to the photoconductor 42. When the light is applied from the image reading section 4 to the periphery of the photoconductor 42, a charge-distribution pattern is formed thereon. The charge-distribution pattern (hereinafter called "electrostatic latent image") is changed into a visible one, as will be described later.

The first developing device 43 and the second developing device 44 are designed to apply two toners of different types, respectively, to the photoconductor 42. Either of them is selected and operated to apply the toner to the photoconductor 42, thereby to change the electronic latent image to a toner image.

The transferring device 45 and the AC voltage-applying unit 46 are formed integral with each other. The device 45 is used to transfer the toner image from the photoconductor 42 to a paper sheet P. The AC unit 46 is designed to apply an AC voltage to the paper sheet P, thereby to separate the sheet P from the photoconductor 42.

The fixing unit 47 is designed to apply heat and pressure to the paper sheet P and, hence, the toner on the sheet P, which forms the toner image, thereby to fix the toner image on the paper sheet P.

The cleaning unit 48 is used to clean the photoconductor 42. More precisely, it removes the residual toner from the periphery of the photoconductor 42, thereby to change the charge distribution of the photoconductor 42 back to an initial charge.

The developing devices 43 and 44 can be replaced by new developing devices of the same size and shape. Alternatively, only the first developing device 43 can be replaced by a new one. In the latter case, the device 43 contains mono-color toner, whereas the device 44 contains black toner. Further, the first developing device 43 can be replaced by a new developing device 43 containing either toner of the same color or toner of a different color. The display 18*e* (see FIG. 1) of the control panel 18 displays the color of the toner supplied from the developing device 43.

The cassettes 14*a* and 14*b* are located on the right of the image forming section 6—either partly inserted in the housing of the copying machine 2 and partly protruding therefrom. The first paper cassette 14*a* contains a stack of paper sheets P (or OHP sheets, in some case) of one size. The second paper cassette 14*b* contains a stack of paper sheets P (or OHP sheets, in some case) of another size. Paper sheets are fed to the image forming section 6 from either the cassette 14*a* or the cassette 14*b* in accordance with a paper select signal (described later) control panel 18.

The material delivering section 8 has two paper-feeding rollers 51*a* and 51*b*, a friction roller 52, two pair of paper-transferring rollers 53*a* and 53*b*, two pair of paper-transferring paths 54*a* and 54*b*, and a timing located between the image forming section 6 and the first paper cassette 14*a*, for feeding the paper sheets P, piece by piece, from the cassette 14*a* toward the section 6. The second paper-feeding roller 51*b* is located between the image forming section 6 and the second paper cassette 14*b*, for feeding the paper sheets P, piece by piece, from the cassette 14*b* toward the section 6. The first paper-transferring roller 53*a* is provided between the first paper-feeding roller 51*a* and the photoconductor 42, for transferring the paper sheets P, piece by piece, from the roller 51*a* toward the photoconductor 42. Similarly, the second paper-transferring roller 53*b* is provided between the second paper-feeding roller 51*a* and the photoconductor 42, for transferring the paper sheets P, piece by piece, from the roller 51*b* toward the photoconductor 42. Both paper-transferring paths 54*a* and 54*b* are made of a guide plate each. The first path 54*a* guides each paper sheet P from the roller 53*a* to the timing roller 55, whereas the second path 54*a* guides each paper sheet P from the roller 53*b* to the timing roller 55. The timing roller 55 corrects the inclination of each paper P reaching it, and the front edge of the sheet P is aligned with the front side of the toner image formed on the photoconductor 42.

The stack bypass 15 is formed integral with the cover of the first paper cassette 14*a*. On the stack bypass 15 there can be amounted a stack of paper sheets having a size different from the sheets P contained in the cassettes 14*a* and 14*b*, or a stack of paper sheets which are copied on one side or not copied at all and have the same size as the sheets P contained in the cassette 14*a* or 14*b*. The friction roller 52 is located between the stack bypass 15 and the first paper-transferring roller 53*a*; it feeds the paper sheets P, piece by piece, from the stack bypass 15 to the roller 53*a*. Each paper sheet P, thus fed from the stack bypass 15, is supplied to the photoconductor 42 by the roller 53*a* and the timing roller 55.

The photoconductor 42, the paper-feeding rollers 51*a* and 51*b*, the paper-transferring rollers 53*a* and 53*b*, and the timing roller 55 are rotated at the same circumferential speed by the motor 62 (see FIG. 2). Hence, any paper sheet is transferred to the photoconductor 42 at a speed substantially equal to the circumferential speed of the photoconductor 42, no matter whether paper has been supplied from the cassette 14*a*, the cassette 14*b*, or the stack bypass 15.

As is shown in FIG. 2, a fixing unit 47 and a paper transporter 56 are located on the left side of the photoconductor 42. The transporter 56 is provided between the image forming section 6 and the fixing unit 47. The device 56 has a plurality of endless belts. When driven by a drive unit (not shown), these endless belts transfer a paper sheet P from the image forming section into the gap between the heater roller 57 and press roller 58 of the fixing unit 47. The fixing unit 47 includes a heater roller 57 and a press roller 58, which extend parallel to each other. The heater roller 57 is a hollow cylinder and contains a heater lamp 57*a*. The roller 57 applies heat to the paper sheet P passing through the gap between it and the press roller 58, whereas the press roller 58 applies pressure to the paper sheet P. The heat melts the toner (defining the image), whereby the image is fixed on the paper sheet P.

Exit rollers 16 deliver the paper sheet P, which has been image-fixed by the fixing unit 57, from the housing of the copying machine 2 onto the tray 16*a* secured to the side of the housing opposing the side on which the cassettes 14*a* and 14*b* are provided A tray 16*a* receives and hod the copied sheets P, one upon another.

As may be understood from FIG. 3, the first motor 60 can drive both the image forming section 6 and the material delivering section 8, at either a first speed and a second speed lower than the first. The first motor 60 drives these sections 6 and 8 at the first speed in order to make a black-and-white copy. Alternatively, it drives the sections 6 and 8 at the second speed to provide a color copy.

On the other hand, the second motor 62 is used to drive the developing devices 43 and 44, etc., and a constant speed. The second motor 62 is connected to a clutch mechanism (not shown). The cooling fan 64 can be rotated, either by itself or along with both developing devices 43 and 44.

As is shown in FIG. 4, the controller 70 is connected to the control panel 18. It is also connected to a motor driver 72, a lamp driver 74, a power supply. As has been explained, the control panel 18 generates control signals when operated by an operator. The motor driver 72 is used to drive the first motor 60, the second motor 62, and others motors, e.g., the pulse motor. The lamp driver 74 is used to turn the lamp 21 and the heater lamp 57*a* ON and OFF.

The controller 70 includes a RAM (Random Access Memory) 76 and a ROM (Read Only Memory) 78. The RAM 76 temporarily stores various copying conditions and modes, such as the number N of copies required, the magnification M selected, the paper size S selected, and the copy color C desired. The ROM 78 stores instructions for operating some components of the copying machine 2 and also various data items required for the copying process.

The operation of the copying machine 2, described above, will now be explained.

First, a document D is mounted on the document table 10. Then, the document cover 12 is closed, pressing the document D onto the table 10. After or before the document D is thus mounted and pressed on the table 10, the keys of the controller 18 are pushed, thereby input inputting to the RAM 76 the data items representing the number N of copies required, the magnification M selected, the paper size S selected, and the copy color C desired. Thereafter, the print key 18*c* is pushed, generating a print start signal. As a result, copying process is started.

Upon receipt of the print start signal, the lamp driver 72 turns on the lamp 21. The lamp 21 emits light, which is reflected by the reflector 22 and applied to the document D, thus illuminating the document D. The light reflected from the reflector 22 illuminates an elongated region of the document D. The lamp 21 is kept on while the first carriage 20 is moving forward, thus scanning the document D to read an image from the document D.

The light reflected from the document D passes through the slit region extending from the reflector 22 to the primary mirror 24. The primary mirror 24 reflects this light, applying the light to the secondary mirror 32. The secondary mirror 32 reflects the light at the angle of 90°, thus guiding the light to the tertiary mirror 34. The tertiary mirror 34 reflects the light at the angle of 90°, thereby guiding the light to the lens 36. The lens 36 has been moved by the motor driver 74 to the position where the lens 36 defines the selected magnification M. The lens 36 converges the light, which is applied to the exposing mirror 38. The exposing mirror 38 reflects the light, applying it to the photoconductor 42. As a result, an electrostatic latent image, which represents the information on the document D, is formed at a desired position on the periphery of the photoconductor 42. The folding mirror 37 is moved to shift the focal point of the lens 36 as the lens 36 is moved, and change the direction in which the light propagates toward the exposing mirror 38.

In the meantime, both carriages 20 and 30 are driven by the pulse motor (not shown) at the speed suitable for copying the image at the magnification M selected, in the sub-scanning direction which intersects with the main-scanning direction at right angles. Hence, the image on the document D is transmitted to the photoconductor 42, in units of data items correspond to the elongated regions of the document D which are illuminated one after another. When the carriages 20 and 30 finish moving over the entire document D in the sub-scanning direction, the document D is completely scanned. At this time, the latent image corresponding to all information on the document D is formed on the periphery of the photoconductor 42.

Whenever the magnification M is changed, the carriages 20 and 30 must be moved in the sub-scanning direction at a different speed. To this end, the motor driver 74 drives the pulse motor at the speed suitable for copying the image at the magnification M newly selected and inputted to the RAM 76.

As has been described, the first developing device 43 contains either color toner or black toner of the same type supplied to the second developing unit 44. When the device 43 contains color toner, the copying machine 2 can produce a color copy, if required, as well as a black-and-white copy.

The image-developing characteristic of any toner available at present changes with ambient temperature and humidity and the rotation speed of the magnetic rollers incorporated in the developing device, and also in accordance with the angle of inclination of the machine 2. Hence, to use toner of a type different from the toner which has been used, the developing conditions stored in the RAM 76 must be changed to new conditions suitable for the physical properties of the toner.

As is known in the art, the developing characteristic of color toner is likelier to change than that of black toner. Therefore, if red toner and black toner supplied to the developing devices 43 and 44, respectively, the first developing device 43 is driven at the second speed, while the second developing device 4 is driven at the first speed which is higher than the first speed, as has been pointed out above.

In order to drive the two developing devices 43 and 44 at different speeds, the copying machine 2 has at least two drive devices as is illustrated in FIG. 3. The circumferential speed of the photoconductor 42, the speed of transferring paper sheets P and the moving speeds of the carriages 20 and 30, are selected in accordance with the type of toner supplied to the developing unit 43 or 44.

Figure 5:
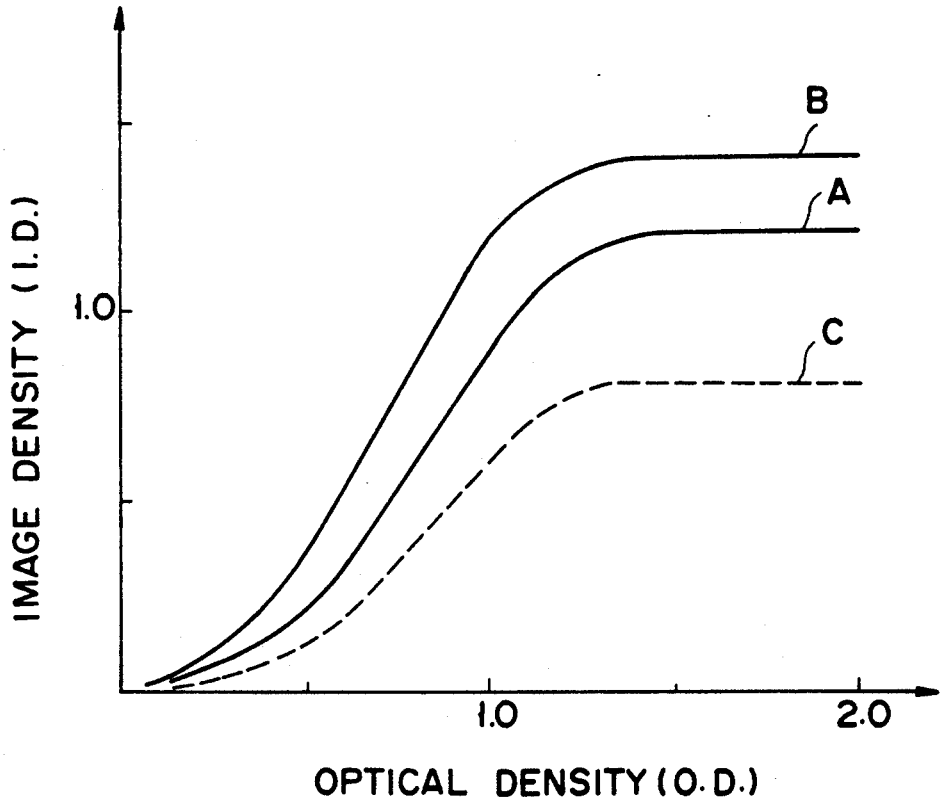
FIG. 5 is a graph representing the developing characteristics of two types of toner and two developing speeds supplied to the developing devices provided in the copying machine of FIG. 1.

FIG. 5 is a graph representing the developing characteristics of two types of toners, in terms of the relationship between the density of the optical image formed on the document D (O.D.) and the density of the image (I.D.) developed by the developing device 43 or 44. Needless to say, the developing characteristic of any toner supplied to either developing device depends on the circumferential speeds of the rollers provided in the developing device and also on the circumferential speed of the photoconductor 42. Curve A represents the developing characteristic of the red toner supplied to the first developing device 43. Curve B indicates the developing characteristic of the black toner supplied to the second developing device 44. Curve C represents the developing characteristic which the red toner supplied to the device 43 rotating a substantially constant speed exhibits when the photoconductor 42 is rotated at the same speed as in the case where the second developing device 44 applies the black toner to the photoconductor 42. As can be understood from curve C, the density of the copied image (I.D.) decreases. This is because the photoconductor 42 is rotated too fast, and the electric charge of the red toner is not balanced with the charge accumulated on the periphery of the photoconductor 42 and determined by the circumferential speed thereof. That is to say, the image density will decrease when the photoconductor 42 rotates at a fast speed, since the developing device 43 supplies substantially constant quantity of the toner per unit time.

If color toner other than red toner is supplied to the first developing device 43, either the photoconductor 42 or the first motor 60 must be driven at the second speed, thereby to maintain the density of the copied image at the value identified by curve A.

As has been described the image on the document D is guided onto the outer periphery of the photoconductor 42, and is converted to an electrostatic latent image. The electrostatic latent image approaches the developing region as the photoconductor 42 is rotated at the speed determined by the toner (either color toner or back toner) which has been selected to develop a toner image from the latent image.

In the developing region, the first developing device 43 or the second developing device 44 applies the selected toner to the periphery of the photoconductor 42. The toner attaches to the electrostatically charged portions of the photoconductor 42, thus developing the image formed on the document D.

More specifically, when the operator pushes the color select key 18*a* on the control panel 18, thus selecting a color toner, i.e., a copying color other than black-,.the first motor 60 is driven at the second speed under the control of a speed control circuit (not shown). As a result of this, the image on the document D is copied in the selected color, since good use is made of the developing characteristic which the color toner exhibits and which is represented by curve A (FIG. 5). The operator may push the cancel key 18*b* to cancel color copying. When he or she pushes the key 18*b*, the copy color selected is changed to black, while the other present copying conditions, e.g., the magnification M and the number N of copies required, remain unchanged. At the same time, the speed of the first motor 60 is increased to the first copying speed.

In the meantime, a paper sheet P is supplied from the first cassette 14*a*, the second cassette 14*b*, or the stack bypass 15 to a position below the photoconductor 42. More precisely, the sheet P is pulled forward from the cassette 14*a*, the cassette 14*b*, or the bypass 15, as the paper-feeding rollers 51*a*, the paper-feeding rollers 51*b*, or the friction roller 52 is rotated. The paper sheet P is then fed toward the photoconductor 42, by the paper-transferring roller 53*a* through the first paper-transferring path 54*a*, or by the paper-transferring roller 53*b* through the second paper-transferring path 54*b*. The timing roller 55, which is driven as the first carriage 20 or the second carriage 30 is moved in the sub-scanning direction, stops the paper sheet P temporarily. The timing roller 55 also positions the paper P such that the front edge of the paper P is aligned with the front side of the toner image formed on the photoconductor 42. Then, the roller 55 is rotated, further feeding the paper sheet P toward the photoconductor 42. The speed of feeding the sheet P to the photoconductor 42 and the speed of the photoconductor 42 are set either to first speed or the second speed (i.e., a speed lower than the first) when the first developing device 43 or the second developing device 44 is selected by operating a switching mechanism (not shown).

The photoconductor 42, with the toner image formed on its periphery, is further rotated, and moving the toner image toward the transferring device 45. At the same time, the paper sheet P is fed to the transferring device 45 by the timing roller 55. The sheet P is attracted to and wrapped around the photoconductor 42, by virtue of the residual charge in the periphery of the photoconductor 42. Then, the sheet P, wrapped around the photoconductor 42, passes through the transferring device 45 as the photoconductor 42 is rotated. The transferring device 45 applies an electric charge to the paper sheet P, which is of the same polarity as the charge already applied from the charging device 41 to the photoconductor 42. As a result of this, the toner is transferred from the photoconductor 42 onto the paper sheet P. Then, the AC voltage-applying unit 46, which is formed integral with the transferring device 45, applies an AC voltage to the paper sheet P, whereby the sheet P is released from the photoconductor 42. As the paper sheet P is mounted onto the transporter 56 as it is released from the photoconductor 42.

The photoconductor 42 is rotated, the cleaning unit 48 removes the residual toner from the periphery of the photoconductor 42, thereby to change the charge distribution thereof back to an initial one. Hence, a new image can be formed on the periphery of the photoconductor 42.

The paper sheet P, with the toner image on it, is transferred forward by means of the transporter 56. It is fed into the gap between the heater roller 57 and the press roller 58. The heater roller 57 applies heat to the paper sheet P, and the heater roller 57 and the press roller 58 applies pressure to the sheet P. The heat melts the toner defining the toner image. The molten toner soaks into the surface of the sheet P, whereby the image is fixed on the paper sheet P. The image-fixed paper sheet P is delivered from the housing of the machine 2 into the tray 16*a*, with its copied side turned upwards.

Figure 6:
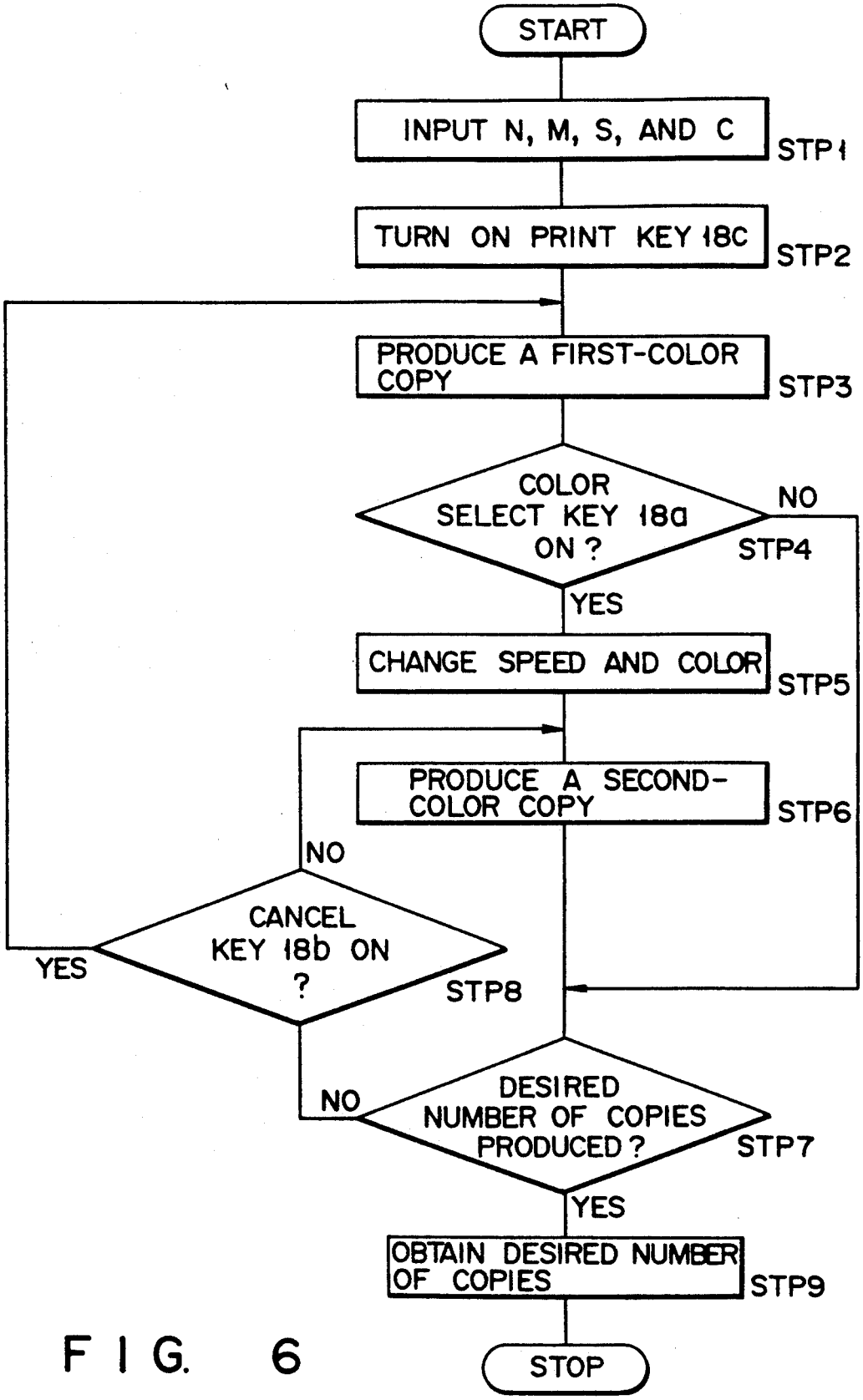
FIG. 6 is a flow chart explaining the copying process performed by the copying machine illustrated in FIG. 1.

With reference to the flow chart of FIG. 6, it will now be explained how the copying machine 2 performs a copying process, in which the toner is switched from black toner to color toner, after some of the desired copies have been produced in black and white.

First, the operator operates the keys of the numeral key pad 18*d* and the other keys of the control panel 18, thus inputting to the RAM 76 the number N of copies desired, the magnification M selected, the paper size S selected, and the copy color C desired, in step STP1. In this instance, N=5, M=81%, S=A4, and C=black. Then, in step STP2, the operator pushes the print key 18*c*, generating a print start signal. In response to the print start signal, the controller 70 generates control signals for driving the first motor 60, the second motor 62, the pulse motor (not shown), the lens motor (not shown, either), and the like. It also generates control signals for turning on the lamp 21, the heater lamp 57*a*, and a plurality of sensors (not shown). The lamp 21 is turned on, and the first carriage 20 and the second carriage 30 are moved in the sub-scanning direction. Simultaneously, the lens 36 and the folding mirror 37 are moved to the positions, where they set the magnification M of 81%.

Next, in step STP3, the image formed on the document D mounted on the document table 10 is guided onto the periphery of the photoconductor 42, thus forming an electrostatic latent image thereon. The second developing device 44 applies black toner to the periphery of the photoconductor 42, changing the latent image to a black-and-white toner image identical to the image formed on the document D.

In step STP4 it is determined whether or not the color select key 18*a* has been pushed. If NO, the operation jumps to step STP7. In step STP7, it is determined whether or not five copies (i.e., the number of copies desired) have been produced. If NO in step STP7, the operation goes to step STP8, in which it is determined whether or not the color-copying cancel key 18*b* has been pushed. If YES in step STP8, the operation returns to step STP3. Then, steps STP3, STP4, STP7, and STP8 are repeated unless it is determined in step STP4 that the color select key 18*a* has been pushed or until it is determined in step STP7 that five black-and-white copies have been produced, unless it is determined in step STP8 that the color-copying cancel key 18*b* has been pushed.

If YES in step STP4, that is, if the color select key 18*a* has been pushed, the operation goes to step STP5. In step STP5, the controller 70 (motor driver 72) changes the speed of the first motor 60, from the first speed to the second speed, and switches the developing device, from the second device 44 to the first device 43. Thus, the copying speed and the copy color are changed. The other copying conditions, i.e., N=5, M=81%, S=A4 remain unchanged. In step STP6, color toner is applied to the photoconductor 42, changing the latent image to a mono-color toner image.

In step STP7, it is determined whether or not five copies (i.e., the number of copies desired) have been produced. If NO in step STP7, the operation goes to step STP8 and then returns to step STP6. Hence, steps STP7, STP8, and STP6 are repeated unless it is determined in step STP8 that the color-copying cancel key 18*b* has been pushed, or until it is determined in step STP7 that four mono-color copies have been produced.

If YES in step STP7, that is, one black-and-white copy and four mono-color copies have been produced, the operation goes to step STP9. In step STP9, the controller 70 stops driving the motors 60, 62 and the other.

As has been described, if the operator pushes the print key 18*c* after setting the printing conditions N, M, S, and C, the copying machine 2 produces the desired colored hard copies of the image formed on the document D. If the operator pushes the color select key 18*a* in the course of such a production, the remaining hard copies produced from the machine 2 then will have a selected color unless the operator the color-copying cancel key 18*b* or until all of the copies have been produced.

A copying machine 102, which is different from the copying machine 2 and is a second embodiment of this invention will now be described with reference to FIGS. 7, 8, and 9. In these figures, the same reference numerals designate the components identical to those shown in FIGS. 1, 2, and 4. The components, which are identical to those shown in FIGS. 1 to 4, will now be described in detail.

Figure 7:
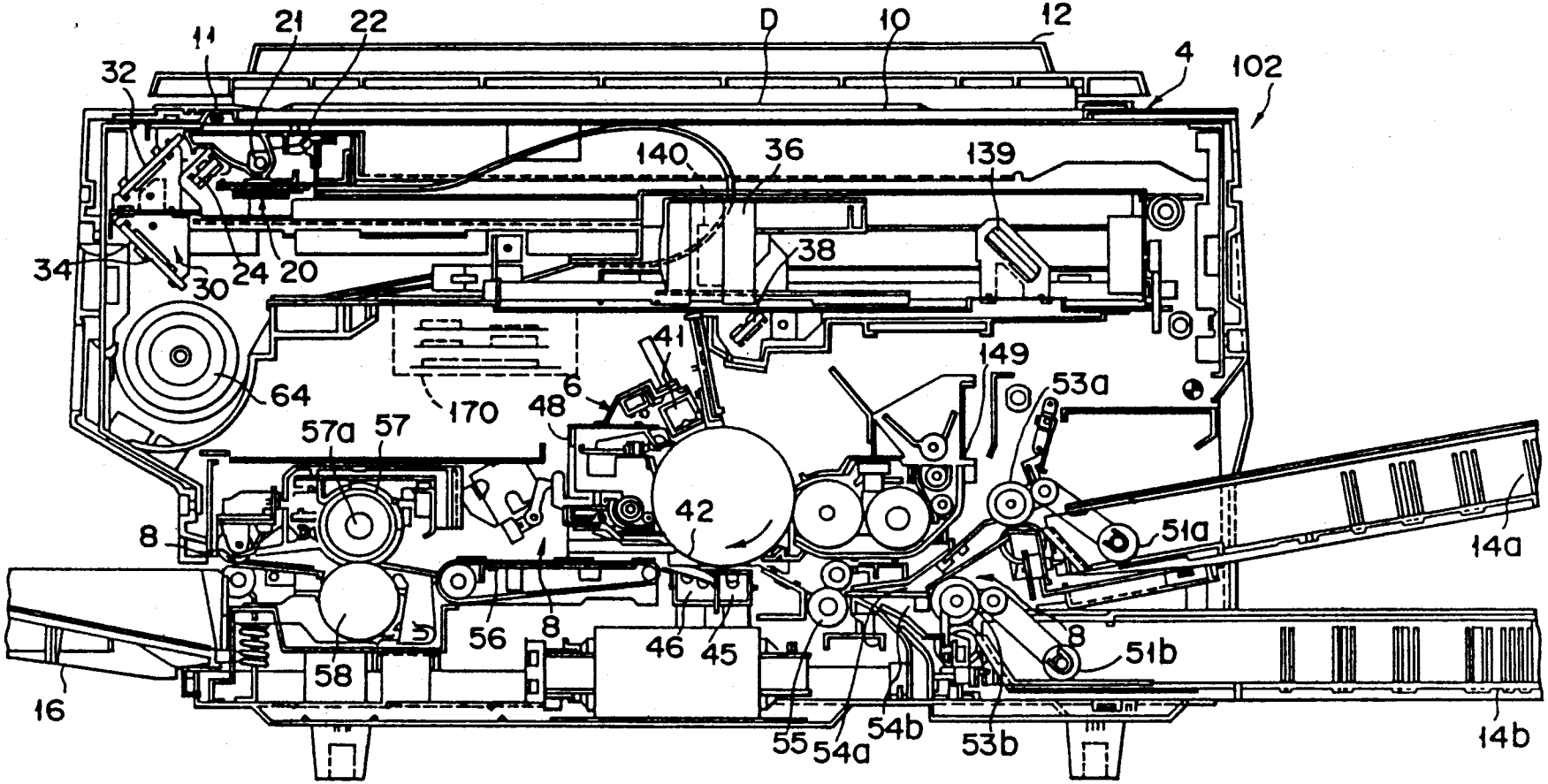
FIG. 7 is a sectional view showing a copying machine according to a second embodiment of the present invention.

As is illustrated in FIG. 7, the copying machine 102 includes an image reading section 4, an image forming section 6, and a material delivering section 8. All these sections, except the image reading section 4, are located within the housing of the machine 102.

The image reading section 4 is a top portion of the copying machine 2, and includes a document table 10, a document size plate 11, and a document cover 12. The image reading section 4 further includes a control panel 118. The control panel 118 will later be described in detail, with reference to FIG. 8. The image reading section 4 is designed to apply light to the document D mounted on the document table 10, thus illuminating the document D, and to apply the light reflected from the document D to the image forming section 6.

The image forming section 6 has a photoconductor 42. The light from the image reading section 4 is applied onto the photoconductor 42, thereby forming an electrostatic latent image thereon.

The material delivering section 8 is designed to feed a plain paper sheet P to the image forming section 6, supplies the sheet P with the image formed on it by the section 6, and deliver it from the copying machine 102.

The copying machine 102 has two motors 60 and 62, both being identical to those shown in FIG. 3. Also the machine 102 has a pulse motor (not shown), a lens motor (no shown, either), and a controller 170 which is schematically illustrated in FIG. 9. The motor 60 drives the photoconductor 42 and the motor 62 drives developing device 149. The pulse motor is used to move carriages 20 and 30, which are shown in FIG. 7 and will be later described, and the lens motor is employed to move lens 36 and an exposing mirror 139, both shown in FIG. 7. The controller 170 controls the image reading section 4, the image forming section 6, and the material delivering section 8. It also controls some other components of the machine 102 in accordance with the signals input by operating the control panel 118.

The image reading section 4 has a first carriage 20 and a second carriage 30. These carriages 20 and 30 are located below the document table 10 and, hence, within the housing of the copying machine 102. A lamp 21, a reflector 22, and a primary mirror 24 are integrally formed with the first carriage 20. A secondary mirror 32 and a tertiary mirror 34 are integrally formed with the second carriage 30.

The image forming section 4 further includes a lens 36, an exposing mirror 139, and an image density sensor 140. The lens 36 converges the light reflected by the tertiary mirror 34. The exposing mirror 139 can be moved by a lens motor (not shown), changing the lengths of an optical path extending from the output surface of the lens 36 and the photoconductor 42. It reflects the light supplied from the lens 36 to the periphery of the photoconductor 42. The image density sensor 140 is located near the lens 36, for determining the type of image formed on the document D (an image consisting of lines only, an image having a photographic part, an image having a solid part, or the like) or detecting the optical density (O.D.) of the image.

The image forming section 6 includes the photoconductor 42, as has been described. The photoconductor 42 is a cylindrical drum located at the center of the image forming section 6. The section 6 further includes a charging device 41, a developing device 149, a transferring device 45, an AC voltage-applying unit 46, a fixing unit 47, and a cleaning unit 48—all arranged around the periphery of the photoconductor 42. These components 41, 149, 46, 47, and 48 perform the same function as their counterparts of the first embodiment.

The photoconductor 42 is rotated by the first motor 60 which can be driven at a first speed R1 and a second speed R2. The first speed R1 is higher than the second speed R2. The developing device 149 is driven by the second motor 62, which is driven at a constant speed.

Figure 8:
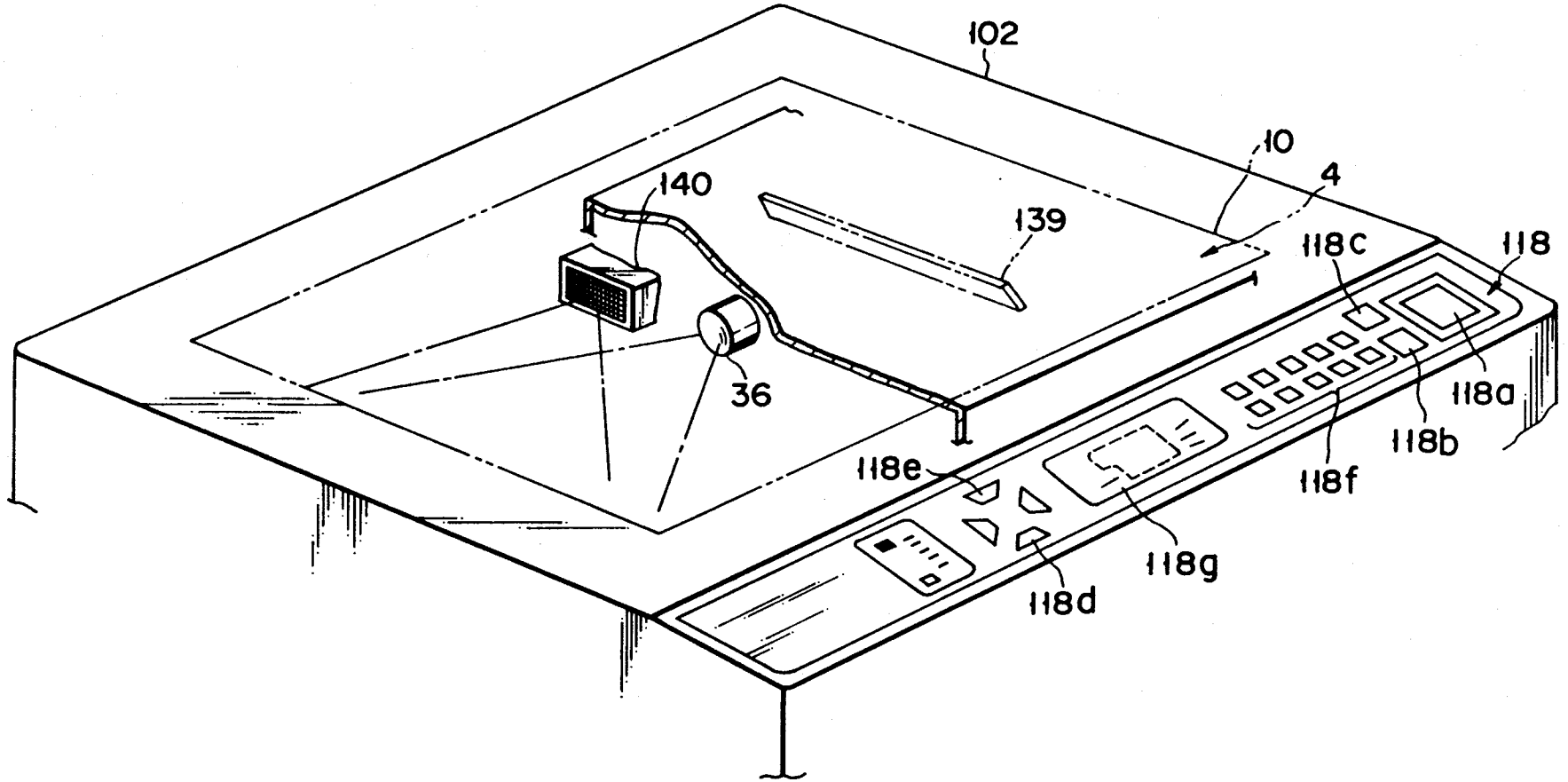
FIG. 8 is a perspective view illustrating the top portion of the copying machine shown in FIG. 7.

As is shown in FIG. 8, the control panel 118 has various keys which an operator will push to set the desired copying conditions and to input control signals and the like. Among these keys are a print key 118*a*, a clear key 118*b*, an all-clear key 118*c*, a high-speed mode key 118*d*, an automatic speed-change key 118*e*, and a numeral key pad 118*f*. The print key 118*a* is pushed to input a copying start signal. The clear key 118*b* is depressed to clear the data being input. The all-clear key 118*c* is operated to change all copying conditions previously set, to initial conditions. The high-speed mode key 118*d* is pushed to input a signal for changing the speed of the first motor 60 which rotates the photoconductor 42 and the like. The automatic speed-change key 118*e* is operated, so that the first motor 60 is automatically driven at the first speed R1 (the high speed) when the image density sensor 140 detects that the image (e.g., an image made from lines only) being copied has a density lower than a reference value, whereby the image is copied faster thereafter. The numeral key pad 18*f* has ten keys which are selectively pushed to input numerals "0" to "9," thereby to set a number of copies desired or input other items of data.

The control panel 118 also has a display device 18*g*. The display device 18*g* is designed to display the data items input by operating the keys (e.g., the data items representing the number N of copies desired, the magnification M selected, the paper size S selected, the copying speed R desired), and also the conditions in which the machine 102 is operating (e.g., the paper cassette selected, the position of paper jam, and the copying speed desired, and the like).

Figure 9:
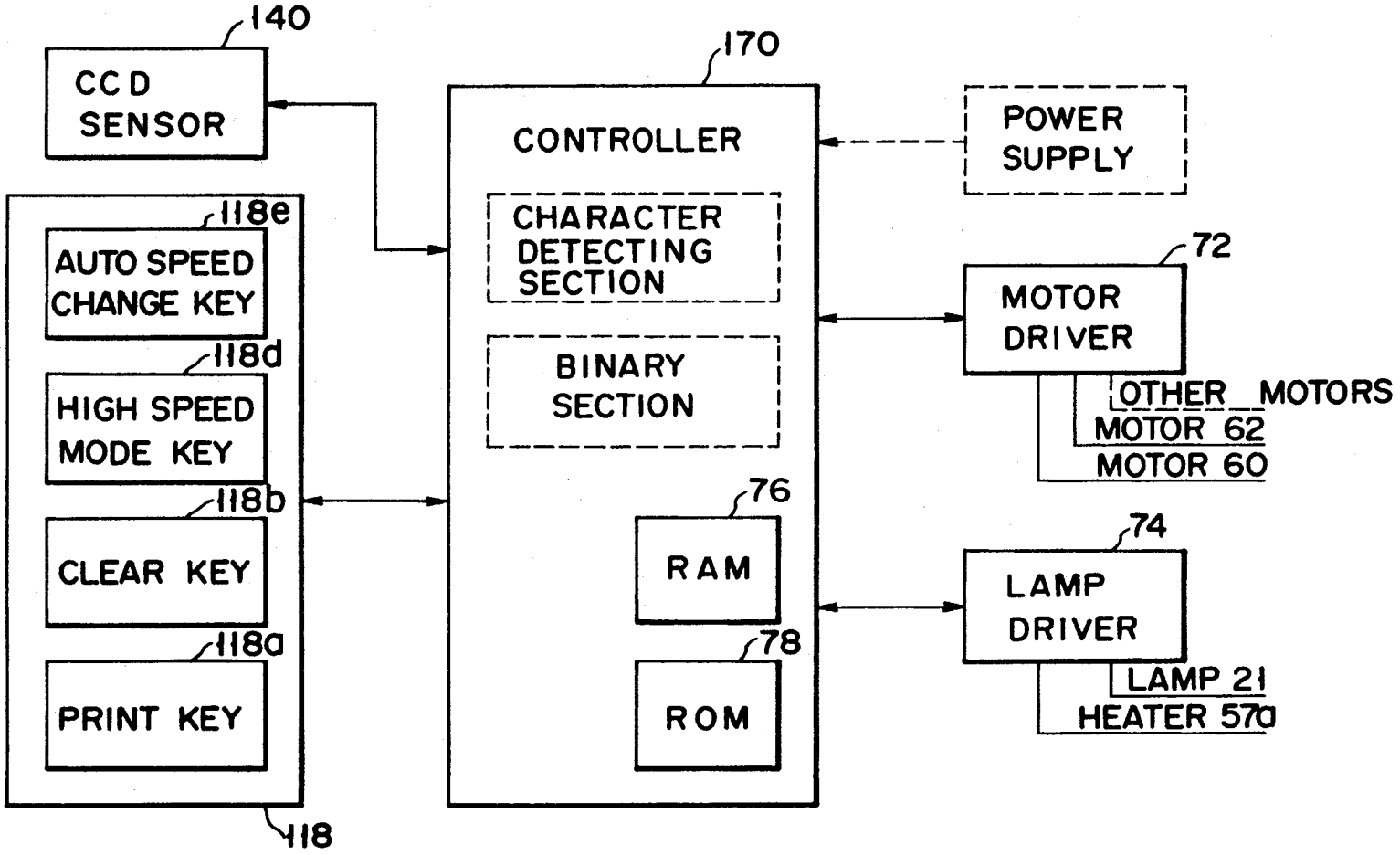
FIG. 9 is a block diagram schematically showing the controller incorporated in the copying machine shown in FIG. 7.

As is shown in FIG. 9, the controller 170 is connected to the control panel 118 and also to a motor driver 72, a lamp driver 74, and a power supply. As has been explained, the control panel 118 generates control signals when it is operated by an operator. The motor driver 72 is used to drive the first motor 60, the second motor 62 and the other motors. The lamp driver 74 is used to turn the lamp 21 and the heater lamp 57*a* ON and OFF.

The controller 170 includes a RAM 76 and a ROM 78. The RAM 76 temporarily stores various copying conditions and modes, such as the number N of copies required, the magnification M selected, the paper size S selected, and the copying speed R desired. The ROM 78 stores instructions for operating some components of the copying machine 2 and also various data items required for the copying process.

The operation of the copying machine 102, shown in FIGS. 7 to 9 and described above, will now be explained.

First, a document D is mounted on the document table 10. Then, the document cover 12 is closed, pressing the document D onto the table 10. After or before the document D is thus mounted and pressed on the table 10, the keys of the controller 18 are pushed, thereby input to the RAM 76 the data items representing the number N of copies required, the magnification M selected, the paper size S selected, and the copying speed R desired. Thereafter, the print key 118*a* is pushed, generating a print start signal and copying process is started.

Upon receipt of the print start signal, the lamp driver 74 turns on the lamp 21. The lamp 21 emits light, which is reflected by the reflector 22 and applied to the document D, thus illuminating the document D. The lamp 21 is kept on only while the first carriage 20 is moving forward, thus scanning the document D to read an image from the document D. The lamp driver 74 drives the lamp 21 in accordance with the optical density of the image which has been detected by the image density sensor 140. Hence, the lamp 21 emits light whose intensity is suitable for reading the image having any optical density.

The image density sensor 140 is a photoelectric transducer or a CCD sensor, which cannot only detect the optical density (O.D.) of the image formed on the document D, but can also determine the type of image (e.g., an image consisting of lines only, an image having a photographic part, an image having a solid part, or the like).

The light reflected from the document D is applied to the primary mirror 24, and hence to the secondary mirror 32. The secondary mirror 32 reflects the light at the angle of 90°, thus applying the light to the tertiary mirror 34. The tertiary mirror 34 reflects the light at the angle of 90°, thereby guiding the light to the lens 36. The lens 36 has been moved by the lens motor (not shown) to the position where the lens 36 defines the selected magnification M. The lens 36 converges the light, which is applied to the exposing mirror 139. The exposing mirror 139 reflects the light, applying it to the photoconductor 42. As a result, an electrostatic latent image corresponding to the image on the document D, is formed at a desired position on the periphery of the photoconductor 42.

In the meantime, both carriages 20 and 30 are driven by the pulse motor (not shown) at the speed suitable for copying the original image at the magnification M selected, in the sub-scanning direction which intersects with the main-scanning direction at right angles. Hence, the image on the document D is transmitted to the photoconductor 42, in units of data items. As a result of this, the latent image corresponding to all information on the document D is represented on the periphery of the photoconductor 42. The developing device 149 applies toner to the periphery of the photoconductor 42, whereby the latent image is converted into a toner image which is visible.

As has been described, the first motor 60, which can be driven at a first speed R1 and a second speed R2, rotates the photoconductor 42 and drives the material delivering section 8 (more specifically, the rollers 51*a* and 51*b*, rollers 53*a* and 53*b*, the timing roller 55, and the heater roller 57*a*, etc.), whereas the second motor 62, which is driven at the constant speed, drives the developing device 149.

However, as has been pointed out, the image-developing characteristic of the toner, which is a powder of fine particles, changes with ambient temperature and humidity, and also in accordance with the rotation speed of the magnetic rollers used in the developing device 149, the angle of inclination of the machine 102, and the circumference speed of the photoconductor 42. In particular, the circumferential speed of the photoconductor 42 influences the developing characteristic of the toner. More specifically, the electric charge accumulated in the periphery of the photoconductor 42 (the surface potential of the photoconductor 42) is not balanced with the electric charge applied to the toner contained in the device 149, depending on the circumferential speed of the photoconductor 42. In this case, the toner attaches to the periphery of the photoconductor 42, but in an amount less than desired, and the resultant copy image has a density lower than desired.

Figure 10:
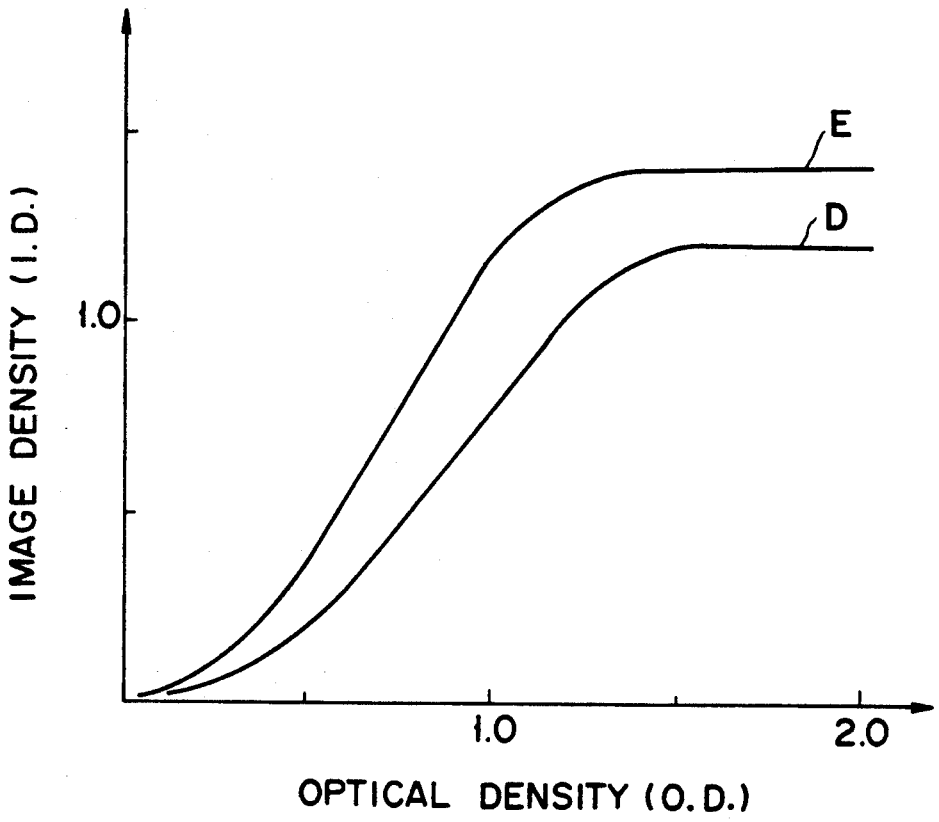
FIG. 10 is a graph representing the developing characteristic of two developing speeds supplied to the developing device provided in the copying machine illustrated in FIG. 7.

FIG. 10 is a graph representing the image-developing characteristic of the developing device 149. More precisely, the graph shows the relationship between the optical density (O.D.) of the image of the document D and the density of a copied image (I.D.). The density of the copied image (I.D.) is determined by the revolution speed of the magnetic rollers of the device 149 and also by the circumferential speed of the photoconductor 42, i.e., the first speed R1 or the second speed R2. In the copying machine 102, the first speed R1 is about 1.5 times higher than the second speed R2, and the photoconductor 42 is rotated at the first speed when the high-speed mode key 118*d* is depressed.

Shown in FIG. 10 are two curves D and E. Curve D represents the developing characteristic which the toner exhibits when the photoconductor 42 is rotated at the first speed R1. Curve E shows the developing characteristic which the toner exhibits when the photoconductor 42 is rotated at the second speed R2.

As can be understood from curve D, the density of the copied image (I.D.) with the optical density (O.D.) of the original image. Hence, the high-speed mode key 118*d* is pushed, causing the controller 170 to drive the first motor 60 at the first speed R1, and ultimately rotating the photoconductor 42 at the high speed, in order to copy an image (e.g., consisting of lines only). On the other hand, the high-speed mode key 118*d* is not pushed, whereby the controller 170 drives the first motor 60 at the second (original) speed R2, thus rotating the photoconductor 42 at the low speed, in order to copy an image having a high contrast (e.g., an image having solid parts or a photograph part). Please note that the high-speed mode may be used to copy the photograph, since the curve D exhibits a gentle variation in image density (I.D.).

The toner image, formed on the photoconductor 42, as has been described, is transferred onto a paper sheet P, fixed thereon, and the copied sheet P (i.e., a hard copy) is delivered onto the tray 16*a* from the housing of the copying machine 102, exactly in the same way as with the machine 2 illustrated in FIGS. 1 to 4.

Figure 11:
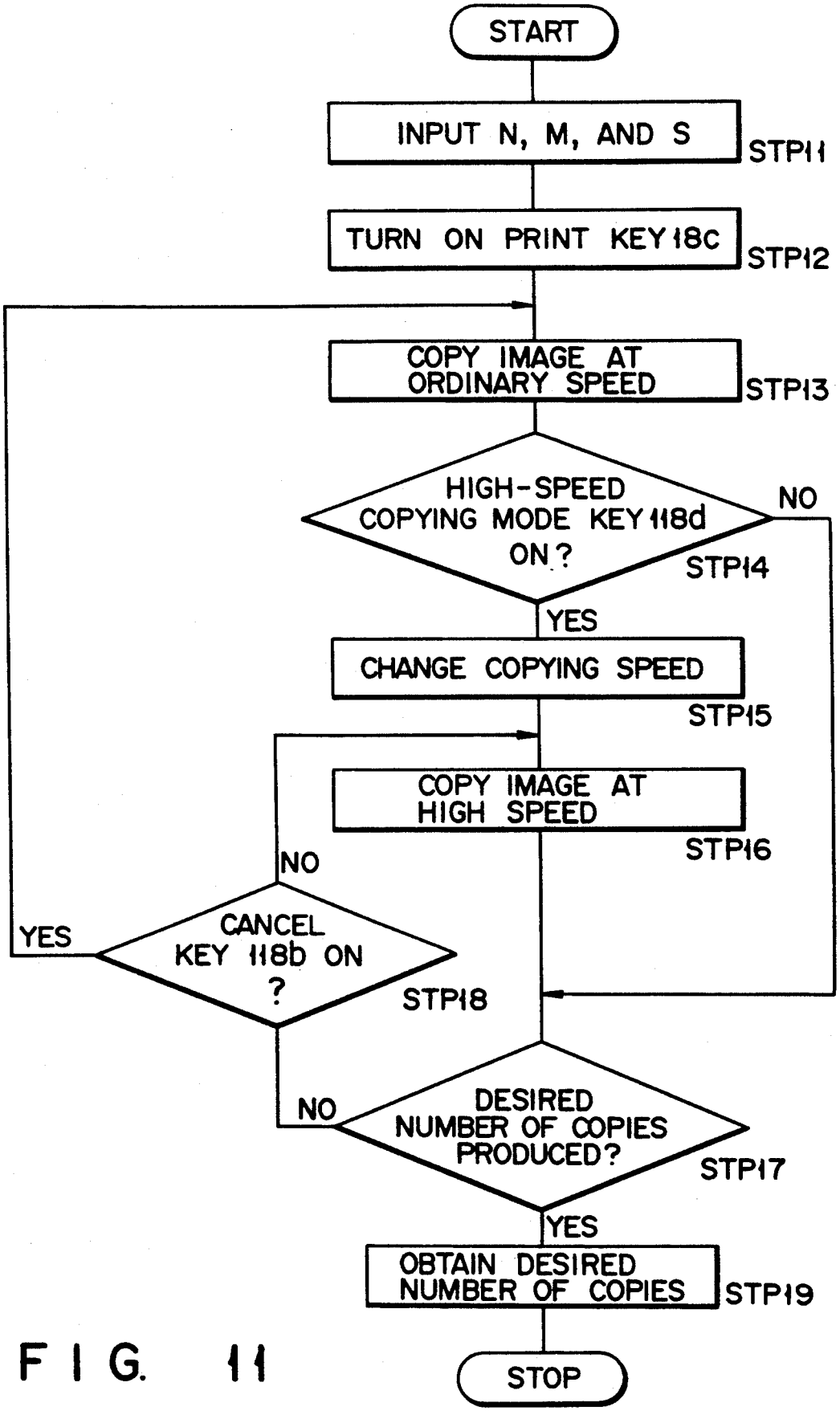
FIG. 11 is a flow chart explaining a copying process carried out by the copying machine shown in FIG. 7.

It will now be explained how to change the copying speed, from the ordinary speed R2 to the high speed R1, at any time during the copying process, with reference to the flow chart of FIG. 11.

First, in step STP11, the operator operates the keys of the numeral key pad 118*f* and the other keys of the control panel 118, thus inputting to the RAM 76 the number N of copies desired, the magnification M selected, and the paper size S selected. In this instance, N=5, M=81%, and S=A4.

Then, in step STP12, the operator pushes the print key 118*a*, generating a print start signal. In response to the print start signal, the controller 170 generates control signals for driving the first motor 60, the second motor 62, and the other motors. It also generates control signals for turning on the lamp 21, the heater lamp 57*a*, and a plurality of sensors (not shown). At the same time, the lens 36 and the exposing mirror 139 are moved to the positions where they set the magnification M to the value of 81%.

Next, in step STP13, the first carriage 20 and the second carriage 30 are moved in the sub-scanning direction. As a result of this, the image formed on the document D mounted on the document table 10 is guided onto the periphery of the photoconductor 42, thereby forming an electrostatic latent image thereon. The developing device 149 applies the toner to the periphery of the photoconductor 42, changing the latent image to a black-and-white toner image identical to the image formed on the document D.

In step STP14 it is determined whether or not the high-speed mode key 118*d* has been pushed. If YES, that is, the operator has depressed the key 118*d* because he or she has found the first copy made has quality lower than desired and, hence, decided that the copying speed should be changed to the first speed R1, the operation goes to step STP15.

In step STP15, the controller 170 controls the motor driver 72, such that the first motor 60 is driven at the first speed R1. The other copying conditions, i.e., N=5, M=81%, S=A4 remain unchanged. Hence, in step STP16, the copying process is performed at the first speed R1, producing the second copy, and the operation goes to step STP17.

In step STP17, it is determined whether or not five copies (the number of copies desired) have been produced and goes to step STP18. In step STP18, it is determined whether or not the clear key 118*b* has been pushed, thus releasing the high-speed copying mode. If NO, the operation returns to step STP16. Then, steps STP16, STP17, and STP18 are repeated unless it is determined in step STP18 that the clear key 118*b* has been depressed, or until all copies have been produced.

If NO in step STP14, that is, if it is determined that the high-speed mode key 118*d* has not been pushed, the operation jumps to step STP17. In the step STP17, it is counted whether or not all copies have been made. If NO in step STP17, the operation goes to step STP18. If NO in step STP18, the operation returns to step STP13. Hence, the sequence of steps STP13 to STP18 is repeated.

If YES in step STP18, that is, if the clear key 118*b* has been pushed, thus releasing the high-speed copying mode, then the controller 170 stops driving the first motor 60, the second motor 62, and the other motors. As a result of this, the sequence of steps STP16, STP17 and STP18 is not performed.

Then, the operation goes to step STP19, in which five hard copies of the image formed on the document D are obtained.

The switching of the copying mode, i.e., step STP14, can be automatically performed, not manually, as will be explained with reference to the flow chart of FIG. 12.

First, in step STP21, the operator operates the keys of the numeral key pad 118*f* and the other keys of the control panel 118, thus inputting to the RAM 76 the number N of copies desired, the magnification M selected, and the paper size S selected. In this instance, N=5, M=81%, and S=A4.

Then, in step STP22, the operator pushes the print key 118*a*, generating a print start signal. In response to the print start signal, the controller 170 generates control signals for driving the first motor 60, the second motor 62, and the other motors. It also generates control signals for turning on the lamp 21, the heater lamp 57*a*, and a plurality of sensors (not shown). At the same time, the lens 36 and the exposing mirror 39 139 moved to the positions where they set the magnification M to the value of 81%.

Next, in step STP23, the first carriage 20 and the second carriage 30 are moved in the sub-scanning direction. As a result, the image formed on the document D mounted on the document table 10 is guided onto the periphery of the photoconductor 42, thereby forming an electrostatic latent image thereon. The developing device 149 applies the toner to the periphery of the photoconductor 42, changing the latent image to a black-and-white toner image identical to the image formed on the document D.

Figure 12:
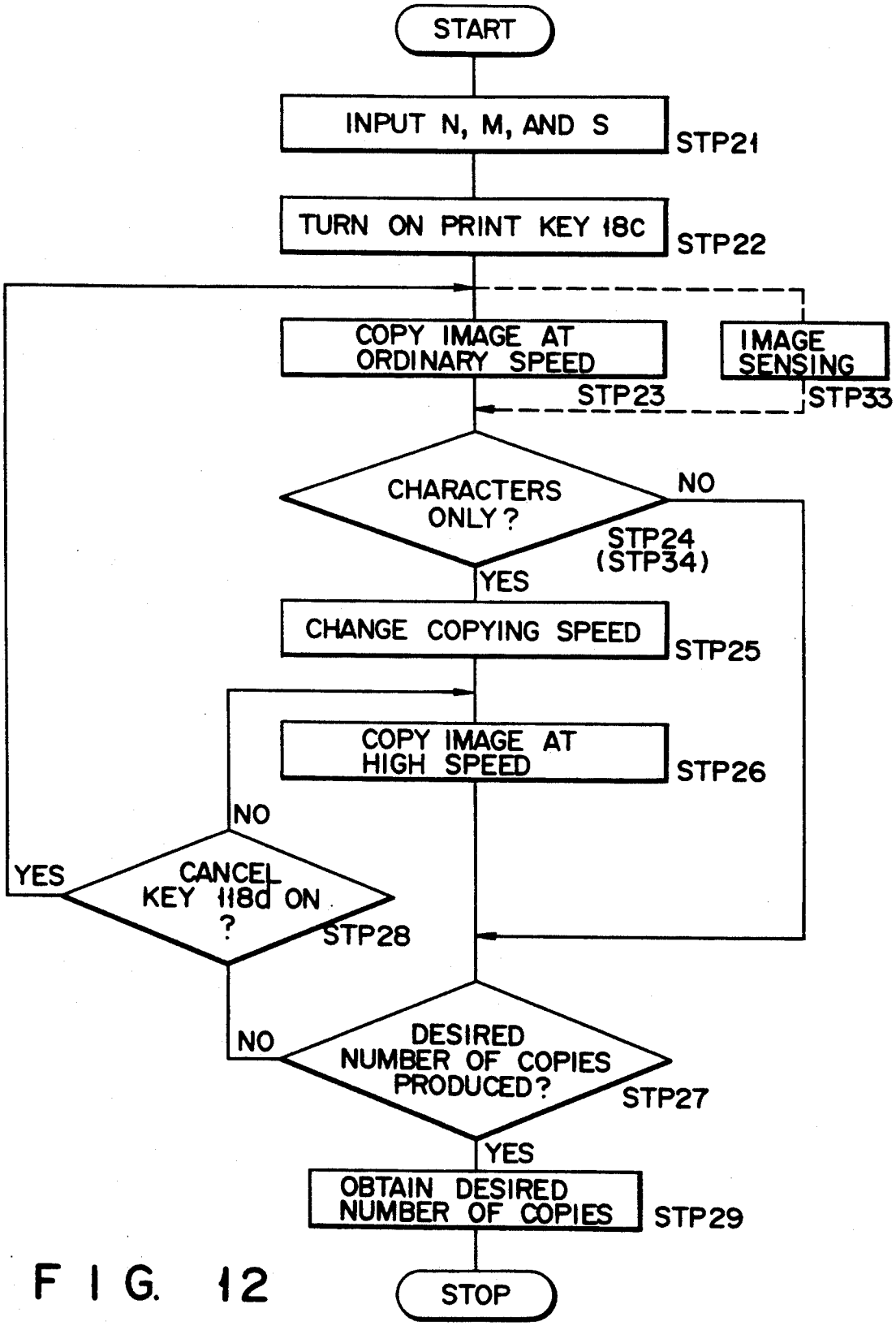
FIG. 12 is a flow chart explaining a modified copying process performed by the copying machine illustrated in FIG. 7.

Alternatively, step STP33 may be executed as shown in FIG. 12. In step STP33, the image density sensor 140 detects the intensity of the light reflected from the image formed on the document D. The data representing the intensity of the light is supplied to the controller 170. The controller 170 determines the type of the image from the intensity of the light, in the method which will be described later with reference to FIGS. 13A and 13B.

In step STP24, it is determined whether or not the image is formed of characters only. If YES, the operation goes to step STP25, in which the controller 170 controls the motor driver 72, such that the first motor 60 is driven at the first speed R1. The other copying conditions, i.e., N=5, M=81%, S=A4 remain unchanged. Hence, in step STP26, the copying process is performed at the first speed, producing the first copy, and the operation goes to step STP27.

In step STP27, it is determined whether or not five copies (the number of copies desired) have been produce and goes to step STP28. In step STP28, it is determined whether or not the clear key 118*b* has been pushed, thus releasing the high-speed copying mode. If NO, the operation returns to step STP26. Then, steps STP26, STP27, and STP28 are repeated unless it is determined in step STP28 that the clear key 118*b* has been depressed, or until all copies have been produced.

If NO in step STP24, that is, if it is determined that the high-speed mode key 118*d* has not been pushed, the operation jumps to step STP27. In the step STP27, it is counted whether or not all copies have been made. If NO in step STP27, the operation goes to step STP28. If NO in step28, the operation returns to step STP23. Hence, the sequence of steps STP23 to STP28 is repeated.

If YES in step STP28, that is, if the clear key 118*b* has been pushed, thus releasing the high-speed copying mode, then the controller 170 stops driving the first motor 60, the second motor 62, and the other motors. As a result, the sequence of steps STP26, STP27 and STP28 is not performed.

Then, the operation goes to step STP29, in which five hard copies of the image formed on the document D are obtained.

Figure 13A:
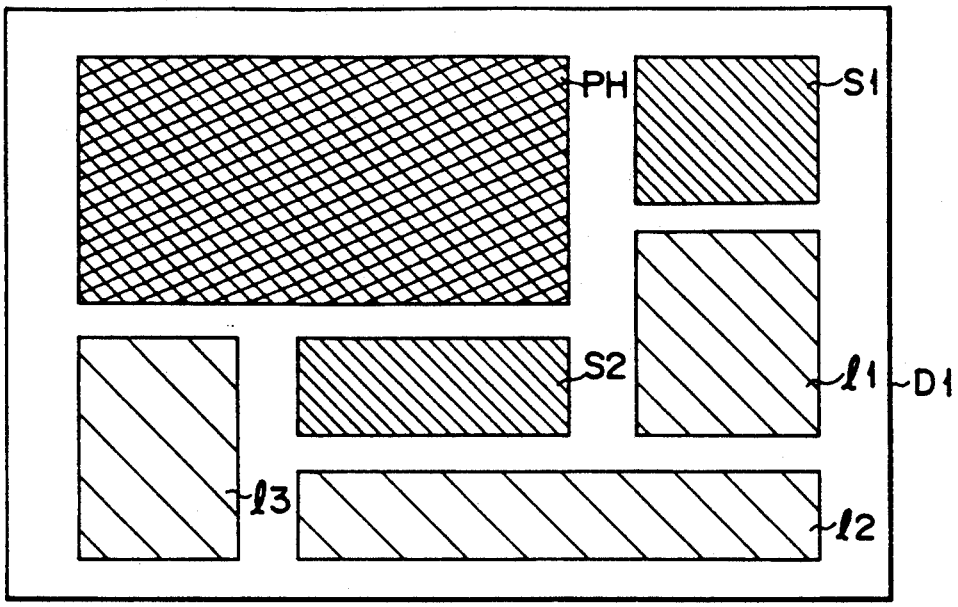
FIGS. 13A, 13B, 14A and 14B are diagrams explaining the method applied to the modified copying process to determine the type of the image formed on a document.
Figure 14A:
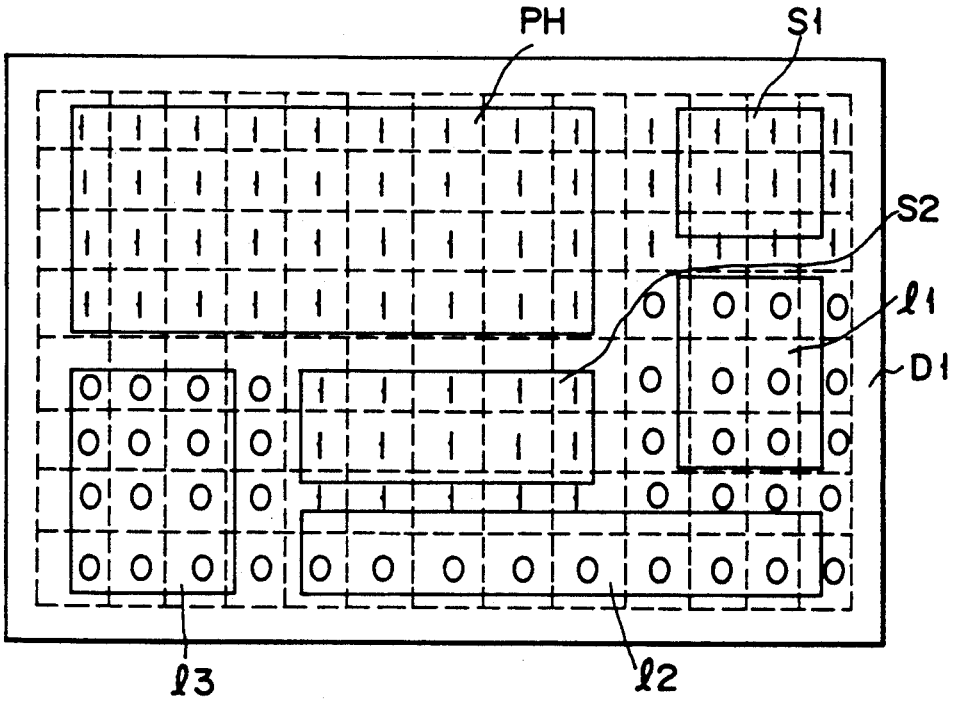
Figure 14B:
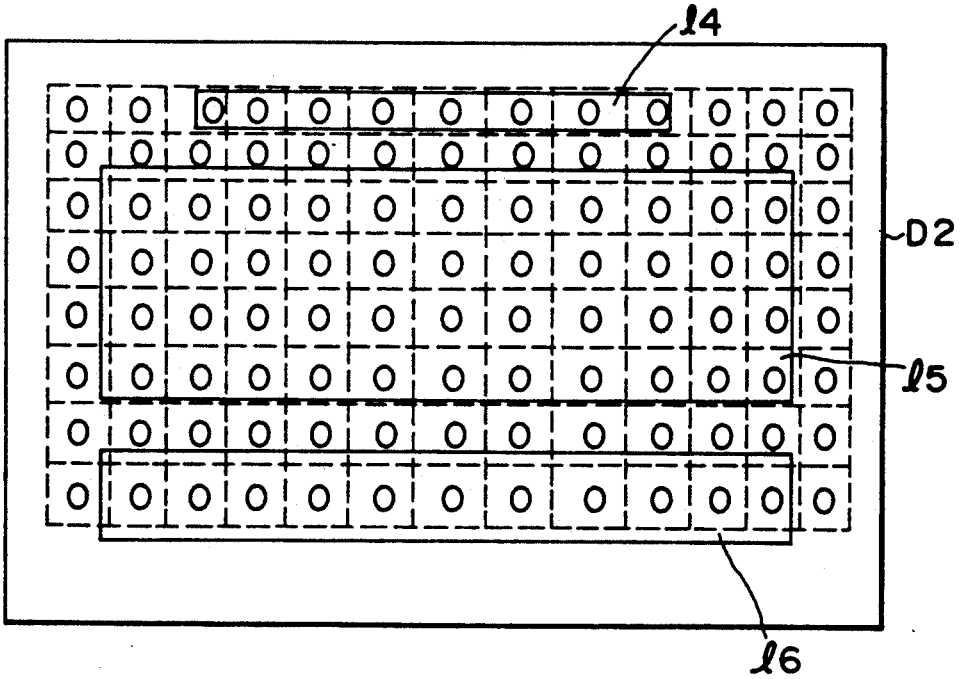

With reference to FIGS. 13A, 14A and 14B, it will now be explained how the controller 170 determines the type of the image formed on the document D.

As has been pointed out, the image density sensor 140 receives the light reflected from the image which is formed on the document D and having characters, graphics, and/or photographs. CCD sensor 140, has so high a resolution that it can detect the brightness of a small portion of the image, unlike a conventional image density sensor which merely detects the average brightness of an image. More precisely, sensor 140 can measure the density of each unit area of the document D, which measures 3 mm×3 mm for example. In other words, it can detect the densities of as many as about 9,900 unit areas if the document size is B4. Therefore, the sensor 140 can determine the type of the image with high accuracy.

Let us assume a first document D1 has six parts as is shown in FIG. 13A—the part S1 and S2 being solid and having a first density, the part PH being a photograph and having a second density, and the parts l1, l2 and l3 consisting of characters or lines only and having a third density. The controller 170 has a character-detecting section for converting the brightness of each unit area (size: 3 mm×3 mm) of the image to a "0" bit when the brightness of the unit area is less than a predetermined threshold value which corresponds to the average brightness of character parts, and to a "1" bit when the brightness of the unit area is equal to or greater than that threshold value. Hence, the controller 170 outputs the binary data which can be schematically shown FIG. 14B. In this instance, the parts l1 to l3 of the image are represented by "0" bits, whereas the part PH and the part S1 and S2 are represented by "1" bits. Hence, the image shown in FIG. 13A is recognized as one not consisting of character only.

Figure 13B:
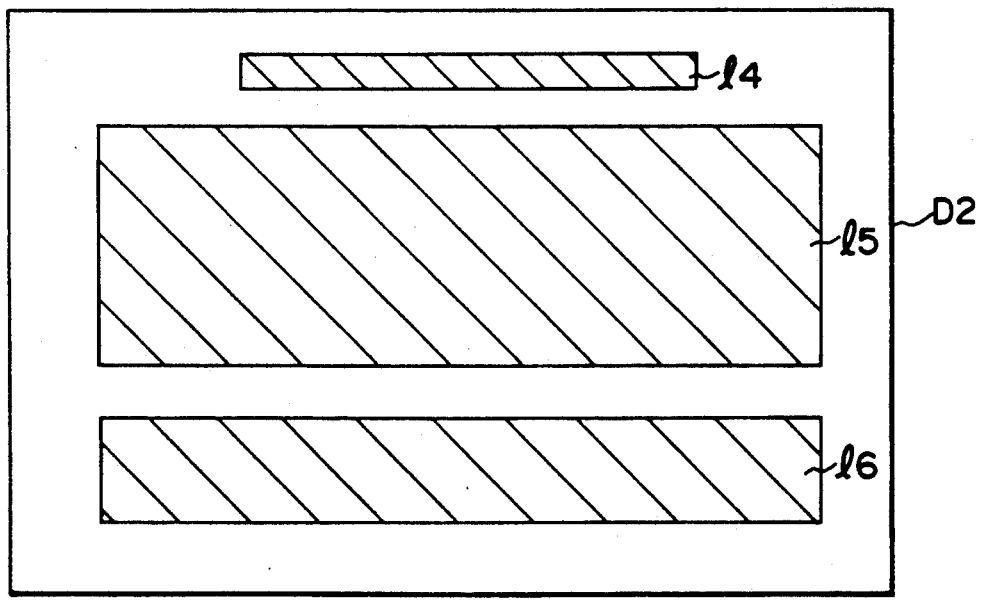

Let us assume a second document D2 has three parts as is shown in FIG. 13B—all parts l4 to l6 being consisting of characters or lines only and having densities. In this case, the character-detecting section of the controller 170 converts the unit areas (size: 3 mm×3 mm) of any part of the image formed on the second document D2 to "0" bits, since every unit area has brightness lower than the threshold value. The controller 170, therefore, outputs the binary data which can be schematically shown in FIG. 14B. Hence, the image, shown in FIG. 13A is recognized as one consisting of characters only.

As has been described above, the present invention provide a copying machine which can be set to a new copying mode even after it has started copying process in an initial mode which is different from the newly set one, and which can be set back to the initial copying mode even after it has been set to the new copying mode.

Also, this invention can provide a copying machine which can start copying an image at high speed, when it is determined, at the time of producing the first copy, that the image being copied is found to consist of characters only.

In either copying machine, the copying conditions initially set, such as the number of copies desired, the copying magnification selected, and the like, are maintained even when the copying mode is changed to the new one, or the copying speed is changed to the high one. Hence, new copies can be produced without break, thereby reducing the amount of toner and paper, and also the copying time to a minimum. This helps to decrease the copying costs.

In the copying machine 2 shown in FIGS. 1 to 4, the first motor 60 is driven at low speed in order to produce color copies, and is driven at high speed in order to produce black-and-white copies. Nonetheless, the machine 2 can be operated in the high-speed copying mode of the machine 102 of FIGS. 7 to 9, so that black-and-white copies can be produced with high efficiency after the copying mode has been switched from the color copying mode to the black-and-white copying mode.

Further, the copying machine 2 shown in FIGS. 1 to 4 can have three or more developing devices for applying black toner and various color toners, so as to form a multi-color copy. If this is the case, the photoconductor 42 can be rotated at high speed, and sheets P can be fed at high speed, so that the multi-color copy can be produced within a short period of time.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus, comprising:

means for moving an image bearing member in a pre-determined direction;

means for scanning an original image to form an latent image corresponding to the original image on said image bearing member moved by said moving means;

means for developing the latent image by supplying a developing agent onto said image bearing member;

means for detecting an image density of the original image;

means for setting, in accordance with the image density detected by said detecting means, a first image forming mode in which said moving means and said scanning means are driven at a first speed or a second image forming mode in which said moving means and said scanning means are driven at a second speed different from the first speed; and means for controlling said moving means and said scanning means so as to drive at the speed corresponding to the mode set by said setting means, wherein said controlling means controls such that said developing means supplies substantially constant quantity of the developing agent per unit time onto said image bearing member irrespective of the set mode.

2. The apparatus according to claim 1, wherein said detecting means has a plurality of detecting elements for detecting the optical densities of the portions of the image.

3. The apparatus according to claim 1, wherein said first and second image-forming modes are different in potential due to the moving speed of the image bearing member.

4. An image forming apparatus comprising:

means for moving an image bearing member in a desired direction;

means for scanning an original image to form an latent image corresponding to the original image on said image bearing member moved by said moving means;

means for developing the latent image by supplying a developing agent onto said image bearing member;

means, having about 100 to 100,000 detecting elements, for detecting optical densities of portions of the original image and for converting the detecting optical densities into binary data items in accordance with predetermined level;

means for setting, in accordance with the image density detected by said detecting means, a first image forming mode in which said moving means and said scanning means are driven at a first speed or a second image forming mode in which said moving means and said scanning means are driven at a second speed different from the first speed;

means for inputting the number N which indicates driven times of said moving means and said scanning means; and means for controlling said moving means and said scanning means to change from the present image-forming mode, which is either one of the first image-forming mode and the second image-forming mode, when N is greater than 2 and at least one of the optical densities detected by said detecting means is lower than the predetermined level.

5. The apparatus according to claim 4, wherein said moving means switches the image-forming mode, from the second mode to the first mode, when a signal is input from said input means for canceling the image-forming mode initially input.

6. An image forming apparatus, comprising:

means for moving an image bearing member in a predetermined direction;

means for scanning an original image to form an latent image corresponding to the original image on said image bearing member moved by said moving means;

means for developing the latent image by supplying a developing agent onto said image bearing member;

means for detecting an image density of the original image, said detecting means having a plurality of detecting elements for detecting the optical densities of portions of the image said detecting means having further means for converting the optical densities detected by said detecting elements into binary data items, and determining whether each optical density is lower than a predetermined value;

means for setting, in accordance with the image density detected by said detecting means, a first image forming mode in which said moving means and said scanning means are driven at a first speed or a second image forming mode in which said moving means and said scanning means are driven at a second speed different from the first speed; and means for controlling said moving means and said scanning means so as to drive them at a speed corresponding to the mode set by said setting means, wherein said controlling means controls said developing means to supply a substantially constant quantity of the developing agent per unit time onto said image bearing member, irrespective of the set mode.

7. The apparatus according to claim 6, wherein controlling means selects the first image-forming mode when the optical densities detected by said detecting elements are lower than the predetermined level.

* * * * *